US010221542B2

(12) United States Patent
Lee et al.

(10) Patent No.: US 10,221,542 B2
(45) Date of Patent: Mar. 5, 2019

(54) SYSTEM AND METHOD FOR ESTIMATING A PAYLOAD OF AN INDUSTRIAL MACHINE

(71) Applicant: Harnischfeger Technologies, Inc., Wilmington, DE (US)

(72) Inventors: Mooyoung Lee, Milwaukee, WI (US); Anab Akanda, Ann Arbor, MI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 0 days.

(21) Appl. No.: 15/380,411

(22) Filed: Dec. 15, 2016

(65) Prior Publication Data

US 2017/0167115 A1 Jun. 15, 2017

Related U.S. Application Data

(60) Provisional application No. 62/267,732, filed on Dec. 15, 2015.

(51) Int. Cl.

| | |
|---|---|
| ***E02F 9/26*** | (2006.01) |
| ***E02F 3/30*** | (2006.01) |
| ***E02F 3/46*** | (2006.01) |
| ***E21C 27/30*** | (2006.01) |
| ***E21C 35/00*** | (2006.01) |
| ***G07C 5/02*** | (2006.01) |
| ***E21C 47/00*** | (2006.01) |

(52) U.S. Cl.

CPC ..... *E02F 9/26* (2013.01); *E02F 3/308* (2013.01); *E02F 3/46* (2013.01); *E02F 9/264* (2013.01); *E21C 27/30* (2013.01); *E21C 35/00* (2013.01); *E21C 47/00* (2013.01); *G07C 5/02* (2013.01)

(58) Field of Classification Search

CPC ..... E02F 9/26; E02F 3/308; E02F 3/46; E02F 9/264; E21C 27/30; E21C 35/00; E21C 47/00; G07C 5/02

USPC ..... 701/34

See application file for complete search history.

(56) References Cited

U.S. PATENT DOCUMENTS

| | | | | |
|---|---|---|---|---|
| 6,518,519 | B1 * | 2/2003 | Crane, III | E02F 9/264 177/136 |
| 2009/0139119 | A1 | 6/2009 | Janardhan et al. | |
| 2014/0107897 | A1 * | 4/2014 | Zhu | E02F 3/435 701/50 |
| 2014/0244101 | A1 * | 8/2014 | Chitty | E02F 9/2054 701/31.6 |

(Continued)

OTHER PUBLICATIONS

Chilean Patent Office Action for Application No. 201603223 dated Feb. 8, 2018 (7 pages including Statement of Relevance).

(Continued)

*Primary Examiner* — Yazan A Soofi

(74) *Attorney, Agent, or Firm* — Michael Best & Friedrich LLP

(57) ABSTRACT

A method of determining payload data of a mining machine having a bucket and a handle. Wherein, the bucket and handle are rotatably coupled via a pin and an actuator. The method includes sensing, via a first sensor, a first force associated with the actuator and sensing, via a second sensor, a second force associated with the bucket. The method further includes determining, via a controller, a rotational angle of the bucket and determining, via the controller, payload data based on the first force, the second force, and the rotational angle.

17 Claims, 6 Drawing Sheets

(56) References Cited

U.S. PATENT DOCUMENTS

| | | | | |
|---|---|---|---|---|
| 2015/0089847 | A1 | 4/2015 | Gross et al. | |
| 2017/0089044 | A1* | 3/2017 | Chitty | E02F 9/267 |

OTHER PUBLICATIONS

Examination Report issued from the Chilean Patent Office for related Application No. 201603223 dated Jul. 17, 2018 (8 pages including Statement of Relevance).

* cited by examiner

SYSTEM AND METHOD FOR ESTIMATING A PAYLOAD OF AN INDUSTRIAL MACHINE

RELATED APPLICATIONS

The present application claims priority to U.S. Provisional Patent Application No. 62/267,732, filed on Dec. 15, 2015, the entire contents of which are hereby incorporated.

TECHNICAL FIELD

The present application relates to industrial machines, and more particularly, a system and method for estimating a payload of an industrial machine. Industrial machines include, but are not limited to, electric rope or power shovels, draglines, hydraulic machines, and backhoes.

Industrial machines, such as electric rope or power shovels, draglines, hydraulic machines, backhoes, etc., are used to execute operations, for example, digging to remove material from a bank of a mine. These machines and/or their components are generally driven by actuator(s), such as but not limited to, electric motors, hydraulic systems, etc.

SUMMARY

Payload data, such as an estimation of the amount of mined material within a bucket of the machine, may be determined. Typically, the payload data is determined by using one or more torque estimations of various actuators (e.g., one or more motors or actuators) of the machine. Such a method and system of estimating payload data is problematic because the actuators, the torque of which is estimated, are often times located a significant distance from the actual payload (e.g., the bucket containing the mined material). Additionally, with certain types of actuators, such as certain types of motors, torque estimation may be inaccurate, and therefore any payload estimates based on such torque estimates, are also inaccurate.

Accordingly, there is a need for a new method and system for estimating a payload of an industrial machine. Therefore, in one embodiment, the application provides an industrial machine including a base. The industrial machine further includes a handle rotationally coupled to the base and a bucket rotationally coupled to the handle via a pin and an actuator. The industrial machine further includes a first sensor, a second sensor, a rotational sensor, and a controller. The first sensor is configured to sense an actuator force. The second sensor is configured to sense a hoist force. The rotational sensor is configured to sense a rotational angle of the bucket. The controller is configured to receive the actuator force, the hoist force, and the rotational angle, and determine a payload data using the actuator force, the hoist force, and the rotational angle.

In another embodiment the application provides a method of determining payload data of an industrial machine having a bucket and a handle, the bucket and handle rotatably coupled via a pin and an actuator. The method includes sensing, via a first sensor, a first force associated with the actuator; sensing, via a second sensor located proximate the pin, a second force associated with the bucket; sensing, via a third sensor located proximate the pin, a rotational angle of the bucket; and determining payload data based on the first force, the second force, and the angle Other aspects of the application will become apparent by consideration of the detailed description and accompanying drawings.

DETAILED DESCRIPTION

Figure 1:
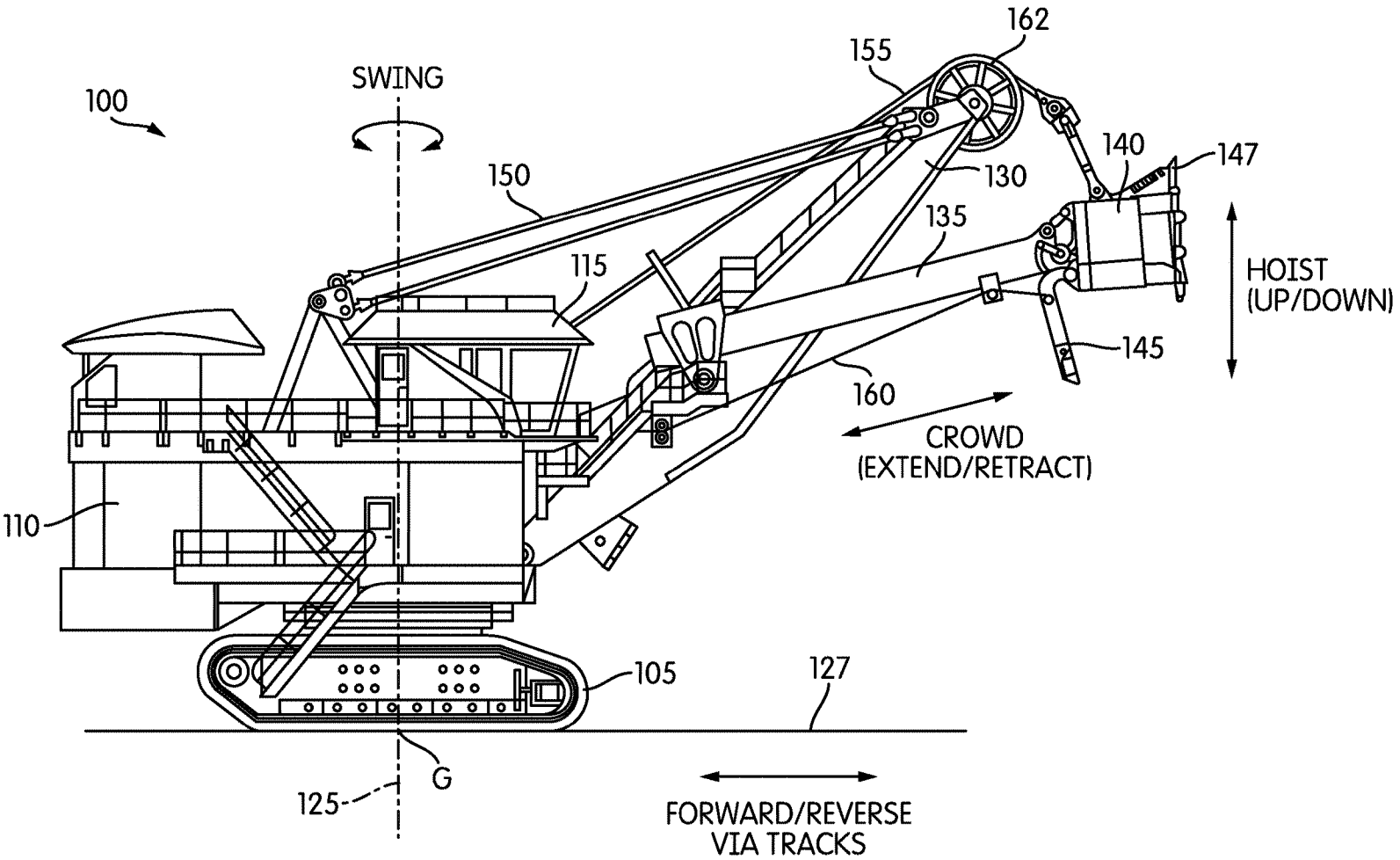
FIG. 1 illustrates an industrial machine according to some embodiments of the application.

Before any embodiments of the application are explained in detail, it is to be understood that the application is not limited in its application to the details of construction and the arrangement of components set forth in the following description or illustrated in the following drawings. The application is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the application. In addition, it should be understood that embodiments of the application may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the application may be implemented in software (e.g., stored on non-transitory computer-readable medium) executable by one or more processors. As such, it should be noted that a plurality of hardware and software based devices, as well as a plurality of different structural components may be utilized to implement the application. Furthermore, and as described in subsequent paragraphs, the specific mechanical configurations illustrated in the drawings are intended to exemplify embodiments of the application and that other alternative mechanical configurations are possible. For example, "controllers" described in the specification can include standard processing components, such as one or more processors, one or more computer-readable medium modules, one or more input/output interfaces, and various connections (e.g., a system bus) connecting the components.

Although the application described herein can be applied to, performed by, or used in conjunction with a variety of industrial machines (e.g., a mining machine, a rope shovel, a dragline with hoist and drag motions, a hydraulic machine, a backhoe, etc.), embodiments of the application described herein are described with respect to an electric rope or power shovel, such as the mining machine illustrated in FIG. 1. The embodiment shown in FIG. 1 illustrates a mining machine, such as an electric mining shovel 100, as a rope shovel, however in other embodiments the mining shovel 100 can be a different type of mining machine, for example, a hybrid mining shovel, a dragline excavator, etc. The mining shovel 100 includes tracks 105 for propelling the mining shovel 100 forward and backward, and for turning the mining shovel 100 (i.e., by varying the speed and/or direction of the left and right tracks relative to each other). The tracks 105 support a base 110 including a cab 115. The base 110 is able to swing or swivel about a swing axis 125, for instance, to move from a digging location to a dumping location. In some embodiments, the swing axis is perpendicular to a horizontal axis 127. Movement of the tracks 105 is not necessary for the swing motion. The mining shovel 100 further includes a boom 130 supporting a pivotable handle 135 (handle 135) and an attachment. In one embodiment, the attachment is a bucket 140. The bucket 140 includes a door 145 for dumping contents from within the bucket 140 into a dump location, such as a hopper, dump-truck, or haulage vehicle. The bucket 140 further includes bucket teeth 147 for digging into a bank of the digging location. It is to be understood that various industrial machines may have various attachments (e.g., a backhoe having a scoop, an excavator having a bucket, a loader having a bucket, etc.). Although various embodiments described within discuss the use of the bucket 140 of the mining shovel 100, any attachment of an industrial machine may be used in conjunction with the application as described.

The mining shovel 100 also includes taut suspension cables 150 coupled between the base 110 and boom 130 for supporting the boom 130; one or more hoist cables 155 attached to a winch (not shown) within the base 110 for winding the cable 155 to raise and lower the bucket 140; and a bucket door cable 160 attached to another winch (not shown) for opening the door 145 of the bucket 140. The mining shovel 100 may further include a boom point sheave 162 rotatably coupled to the boom 130. The boom point sheave 162 may be configured to support the one or more hoist cables 155.

The bucket 140 is operable to move based on three control actions: hoist, crowd, and swing. The hoist control raises and lowers the bucket 140 by winding and unwinding hoist cable 155. The crowd control extends and retracts the position of the handle 135 and bucket 140. In one embodiment, the handle 135 and bucket 140 are crowded by using a rack and pinion system. In another embodiment, the handle 135 and bucket 140 are crowded using a hydraulic drive system. The swing control rotates the base 110 relative to the tracks 105 about the swing axis 125. In some embodiments, the bucket 140 is rotatable or tiltable with respect to the handle 135 to various bucket angles. In other embodiments, the bucket 140 includes an angle that is fixed with respect to, for example, the handle 135.

Figure 2:
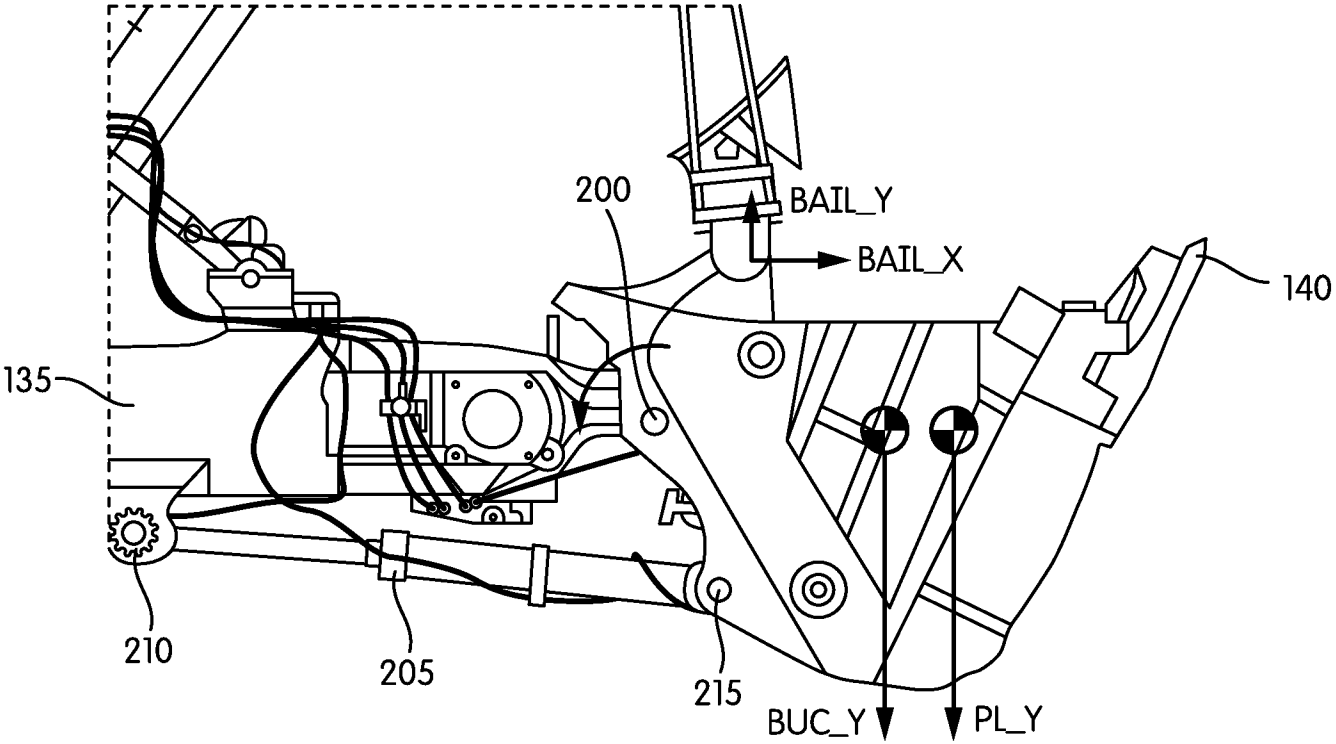
FIG. 2 is a side view of a handle and a bucket of the industrial machine of FIG. 1 according to some embodiments of the application.

FIG. 2 illustrates a side view of the handle 135 and bucket 140 of the mining shovel 100. The bucket 140 may be pivotably attached to the handle 135 via a bucket-handle pin 200. The bucket 140 may be pivotally moved, with respect to the handle 135, via an actuator 205. As illustrated, the actuator 205 may be rotably coupled to the handle 135 via a handle-actuator pin 210. Furthermore, as illustrated, the actuator 205 may be rotatably coupled to the bucket 140 via a bucket-actuator pin 215. In some embodiments, the actuator 205 is a hydraulic actuator. In another embodiment, the actuator 205 may include one or more motors, such as but not limited to, direct-current (DC) motors, alternating-current (AC) motors, and switch-reluctance (SR) motors.

Figure 3:
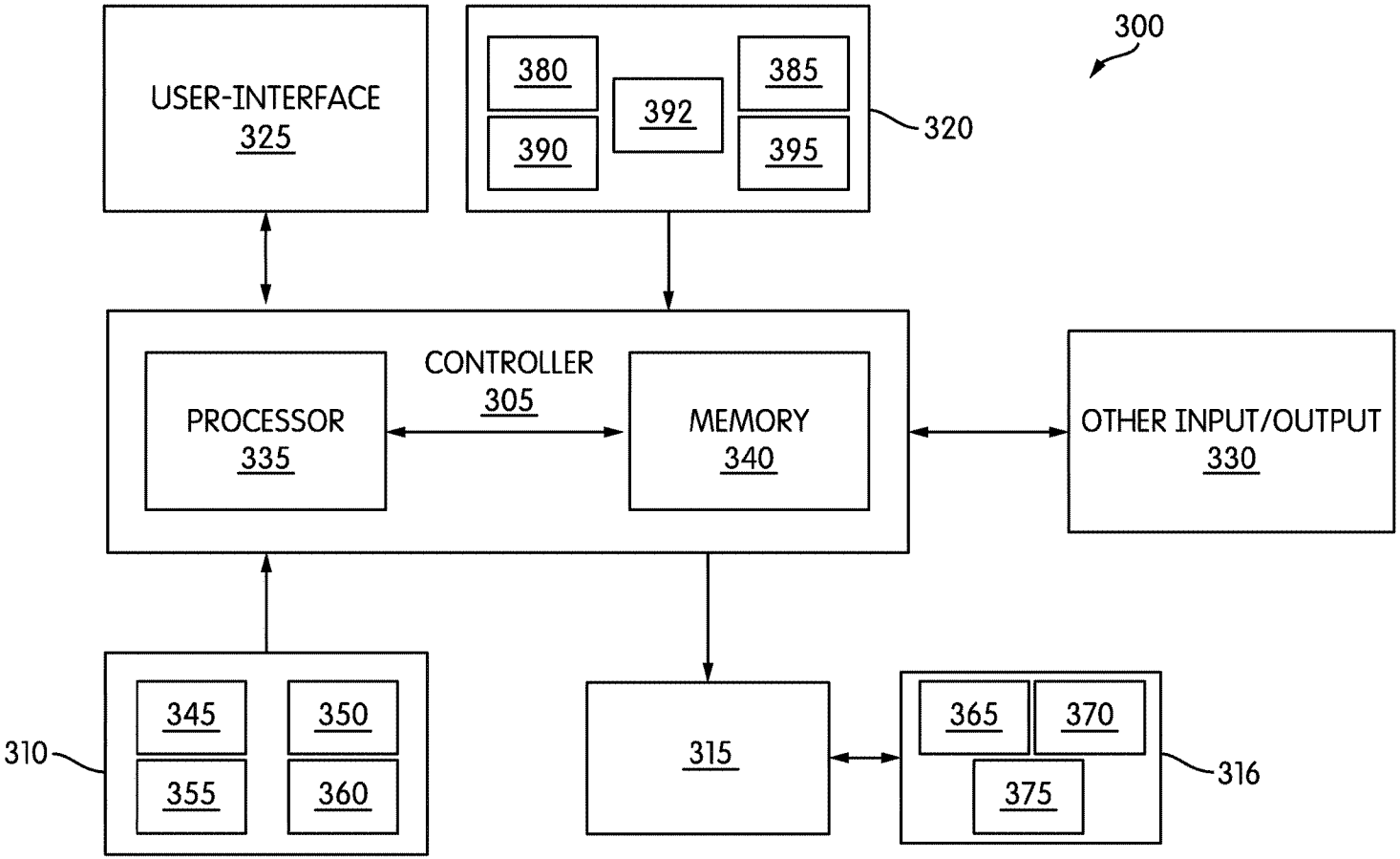
FIG. 3 is a block diagram of a control system of the industrial machine of FIG. 1 according to some embodiments of the application.

As shown in FIG. 3, the mining shovel 100 of FIG. 1 includes a control system 300. It is to be understood that the control system 300 can be used in a variety of industrial machines besides the mining shovel 100 (e.g., a dragline, hydraulic machines, constructions machines, backhoes, etc.) The control system 300 includes a controller 305, operator controls 310, bucket controls 315, sensors 320, a user-interface 325, and other input/outputs (I/O) 330. The controller 305 includes a processor 335 and memory 340. The memory 340 stores instructions executable by the processor 335 and various inputs/outputs for, e.g., allowing communication between the controller 305 and the operator or between the controller 305 and sensors 320. In some instances, the controller 305 includes one or more of a microprocessor, digital signal processor (DSP), field programmable gate array (FPGA), application specific integrated circuit (ASIC), or the like.

The controller 305 receives input from the operator controls 310. The operator controls 310 include a crowd control or drive 345, a swing control or drive 350, a hoist control or drive 355, and a door control 360. The crowd control 345, swing control 350, hoist control 355, and door control 360 include, for instance, operator controlled input devices such as joysticks, levers, foot pedals, and other actuators. The operator controls 310 receive operator input via the input devices and output digital motion commands to the controller 305. The motion commands include, for example, hoist up, hoist down, crowd extend, crowd retract, swing clockwise, swing counterclockwise, bucket door release, left track forward, left track reverse, right track forward, and right track reverse.

Upon receiving a motion command, the controller 305 generally controls bucket controls 315 as commanded by the operator. The bucket controls 315 control a plurality of motors 316 of the mining shovel 100. The plurality of motors 316 include, but are not limited to, one or more crowd motors 365, one or more swing motors 370, and one or more hoist motors 375. For instance, if the operator indicates, via swing control 350, to rotate the base 110 counterclockwise, the controller 305 will generally control the swing motor 370 to rotate the base 110 counterclockwise. However, in some embodiments of the application the controller 305 is operable to limit the operator motion commands and generate motion commands independent of the operator input.

The motors 316 can be any actuator that applies a force. In some embodiments, the motors 316 can be, but are not limited to, alternating-current motors, alternating-current synchronous motors, alternating-current induction motors, direct-current motors, commutator direct-current motors (e.g., permanent-magnet direct-current motors, wound field direct-current motors, etc.), reluctance motors (e.g., switched reluctance motors), linear hydraulic motors (i.e., hydraulic cylinders, and radial piston hydraulic motors. In some embodiments, the motors 316 can be a variety of different motors. In some embodiments, the motors 316 can be, but are not limited to, torque-controlled, speed-controlled, or follow the characteristics of a fixed torque speed curve. Torque limits for the motors 316 may be determined from the capabilities of the individual motors, along with the required stall force of the mining shovel 100.

The controller 305 is also in communication with a number of sensors 320. For example, the controller 305 is in communication with one or more crowd sensors 380, one or more swing sensors 385, one or more hoist sensors 390, an actuator sensor 392, and a pin sensor 395. The crowd sensors 380 sense physical characteristics related to the crowding motion of the mining machine and convert the sensed physical characteristics to data or electronic signals to be transmitted to the controller 305. The crowd sensors 380 include for example, a plurality of position sensors, a plurality of speed sensors, a plurality of acceleration sensors, and a plurality of torque sensors. The plurality of position sensors, indicate to the controller 305 the level of extension or retraction of the bucket 140. The plurality of speed sensors, indicate to the controller 305 the speed of the extension or retraction of the bucket 140. The plurality of acceleration sensors, indicate to the controller 305 the acceleration of the extension or retraction of the bucket 140. The plurality of torque sensors, indicate to the controller 305 the amount of torque generated by the extension or retraction of the bucket 140.

The swing sensors 385 sense physical characteristics related to the swinging motion of the mining machine and convert the sensed physical characteristics to data or electronic signals to be transmitted to the controller 305. The swing sensors 385 include for example, a plurality of position sensors, a plurality of speed sensors, a plurality of acceleration sensors, and a plurality of torque sensors. The position sensors indicate to the controller 305 the swing angle of the base 110 relative to the tracks 105 about the swing axis 125, while the speed sensors indicate swing speed, the acceleration sensors indicate swing acceleration, and the torque sensors indicate the torque generated by the swing motion.

The hoist sensors 390 sense physical characteristics related to the swinging motion of the mining machine and convert the sensed physical characteristics to data or electronic signals to be transmitted to the controller 305. The hoist sensors 390 include for example, a plurality of position sensors, a plurality of speed sensors, a plurality of acceleration sensors, and a plurality of torque sensors. The position sensors indicate to the controller 305 the height of the bucket 140 based on the hoist cable 155 position, while the speed sensors indicate hoist speed, the acceleration sensors indicate hoist acceleration and the torque sensors indicate the torque generated by the hoist motion. In some embodiments, the torque hoist sensor may be used to determine a bail pull force or a hoist force. In some embodiments, the accelerometer sensors, the swing sensors 385, and the hoist sensors 390, are vibration sensors, which may include a piezoelectric material. In some embodiments, the sensors 320 further include door latch sensors which, among other things, indicate whether the bucket door 145 is open or closed and measure weight of a load contained in the bucket 140. In some embodiments, one or more of the position sensors, the speed sensors, the acceleration sensors, and the torque sensors are incorporated directly into the motors 316, and sense various characteristics of the motor (e.g., a motor voltage, a motor current, a motor power, a motor power factor, etc.) in order to determine acceleration.

The actuator sensor 392 senses a displacement of the actuator 205 and/or a force applied by the actuator 205. In such an embodiment, in which the actuator 205 is a hydraulic actuator, the actuator sensor 392 measures the force applied by the actuator 205 by measuring a pressure of the hydraulic actuator. In another embodiment, in which the actuator 205 is a motor, the actuator sensor 392 may be a torque sensor that measures the torque applied by the actuator 205.

The pin sensor 395 senses an angular position, or rotational angle, of the bucket 140 relative to the handle 135. In some embodiments, the pin sensor 395 may additionally measure a mass, or weight, applied at the location of the pin sensor 395. In some embodiments, the mass, or weight, applied at the location of the pin sensor 395 is equivalent to a bail pull force, or hoist force, of the mining shovel 100. In some embodiments, the pin sensor 395 may additionally measure an angular velocity and an angular acceleration of the bucket 140 relative to the handle 135.

The user-interface 325 provides information to the operator about the status of the mining shovel 100 and other systems communicating with the mining shovel 100. The user-interface 325 includes one or more of the following: a display (e.g. a liquid crystal display (LCD)); one or more light emitting diodes (LEDs) or other illumination devices; a heads-up display (e.g., projected on a window of the cab 115); speakers for audible feedback (e.g., beeps, spoken messages, etc.); tactile feedback devices such as vibration devices that cause vibration of the operator's seat or operator controls 310; or other feedback devices.

In operation, the control system 300 may be configured to determine payload data, such as but not limited to, a fill factor of the bucket 140. The fill factor is a percentage (e.g., 0% to 100%) that the bucket 140 is filled with material. As the fill factor varies, the center of gravity of the bucket 140 varies. By knowing the center of gravity, accurate payload data (e.g., an accurate fill factor) may be determined.

Figure 4:
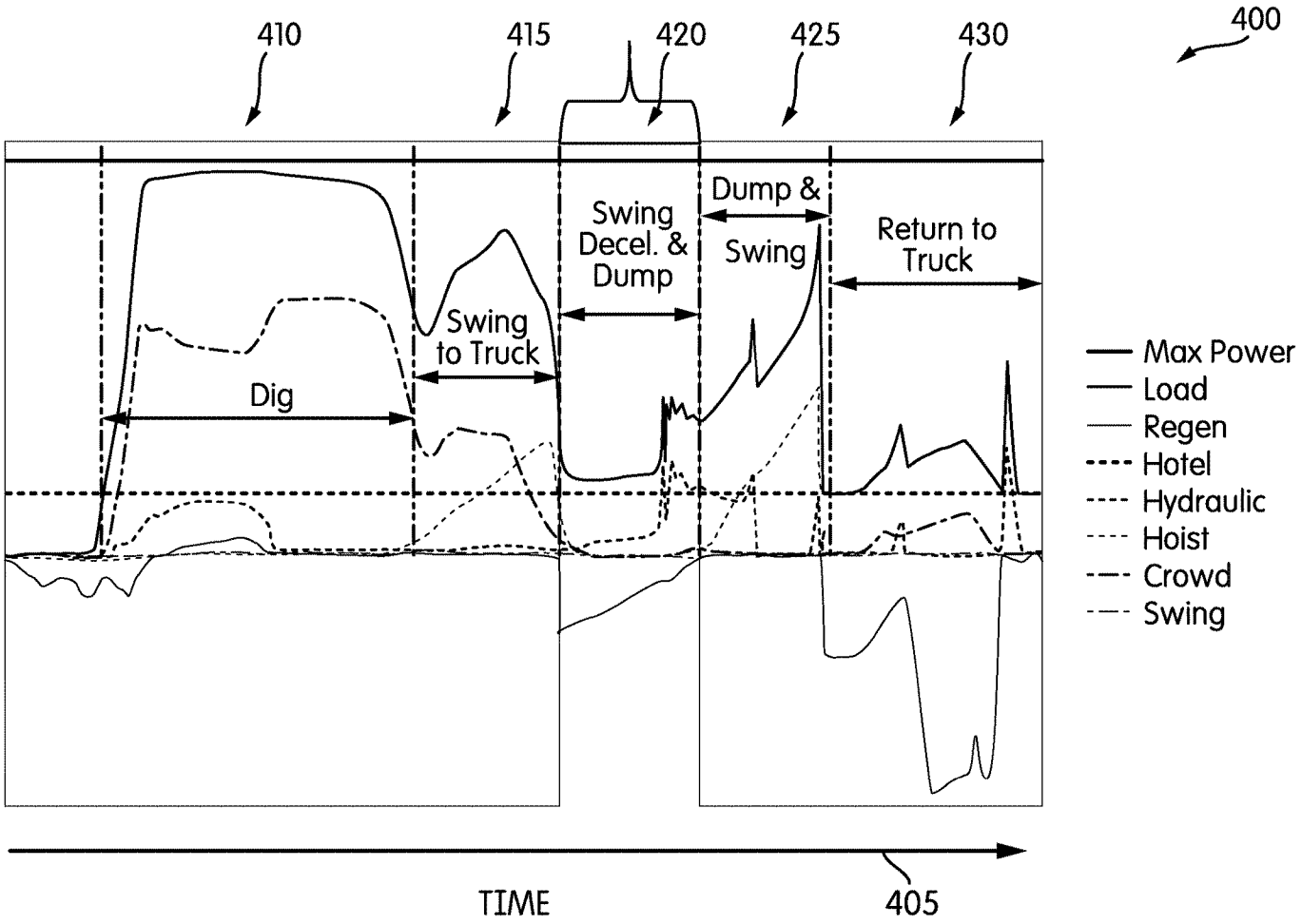
FIG. 4 is a chart illustrating various forces of the industrial machine of FIG. 1 over time.

FIG. 4 is a chart 400 illustrating various forces of the mining shovel 100 over time 405. The chart 400 is divided into a plurality of operations. In the illustrated embodiment, the plurality of operations include, but are not limited to, a dig operation 410, a swing to truck operation 415, a swing deceleration and dump operation 420, a dump and swing operation 425, and a return to truck operation 430. In some embodiments, the payload data (e.g., fill factor of the bucket 140) is determined during the swing deceleration and dump operation 420. However, in other embodiments, the payload data may be determined during a different operation, or during more than one operation.

Figure 5:
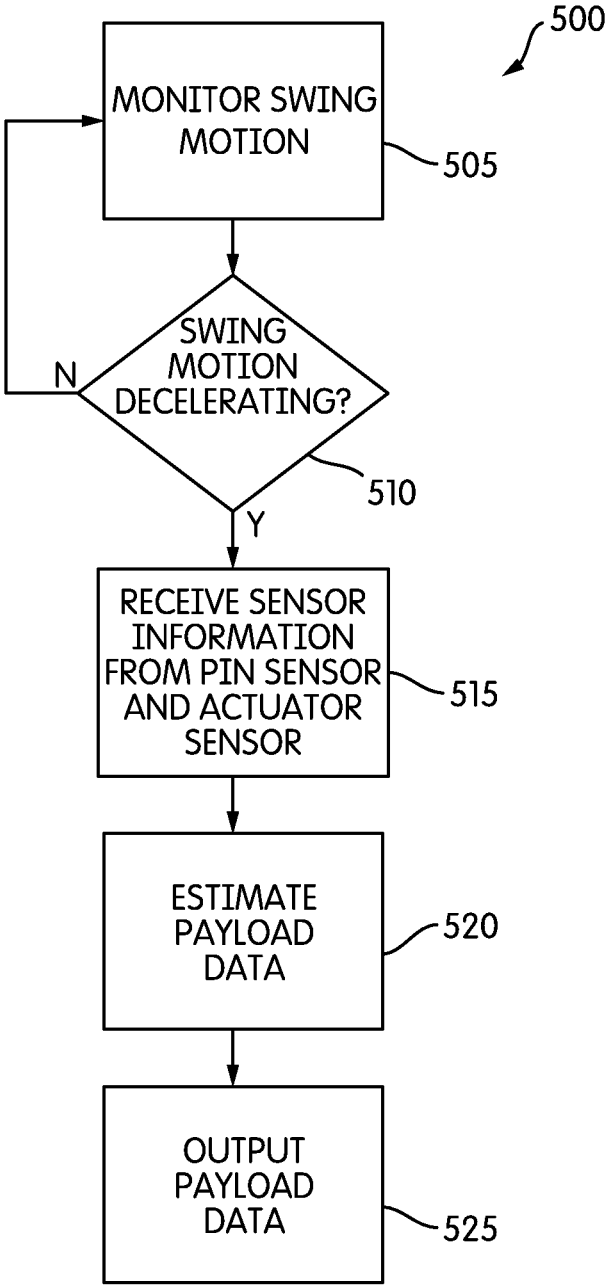
FIG. 5 is a flow chart illustration an operation of the industrial machine of FIG. 1 according to some embodiments of the application.

FIG. 5 is a flowchart illustrating a method or operation 500 in accordance with some embodiments of the application. It should be understood that the order of the steps disclosed in operation 500 could vary. Additional steps may also be added to the control sequence and not all of the steps may be required. The control system 300 monitors the swing motion of the bucket 140 (block 505). The control system 300 determines if the mining shovel 100 is in the swing deceleration and dump operation 420 by determining if the swing motion is decelerating (block 510). If the swing motion is not decelerating, the operation 500 returns to block 505. If the swing motion is decelerating, the control system 300 receives the load pin data (e.g., force, weight, etc.) from the pin sensor 395, the actuator data (e.g., actuator force and actuator displacement) from the actuator sensor 392, and position data (block 515). The control system 300 then estimates the payload data using the received data (block 520). The control system 300 then outputs the payload data (block 525). In some embodiments, the load pin data may be replaced with hoist torque data from the hoist torque sensor 390.

Figure 6:
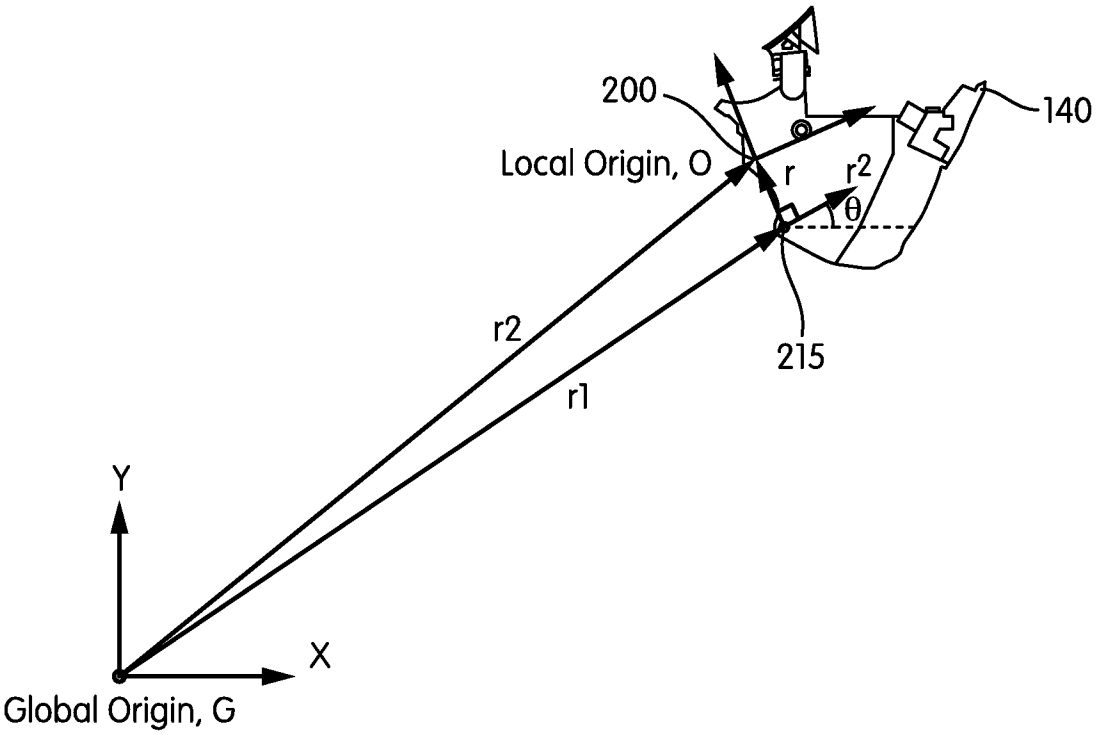
FIG. 6 is a side view of a bucket, and the bucket orientation from a reference point, of the industrial machine of FIG. 1 according to some embodiments of the application.

FIG. 6 illustrates a plurality of vectors associated with the bucket 140. A local origin point O of the bucket 140, along with a global origin point G, are used to determine the plurality of vectors associated with the bucket 140. The local origin point O may be calculated using sensed information from one or more of the hoist sensor 390, the crowd sensor 380, and the sensed displacement of the actuator from the actuator sensor 392, along with the known geometries of the boom 130, the handle 135, the bucket 140, and the boom point sheave 162. In some embodiments, as illustrated in FIG. 1, the global origin point G is located at the intersection of the horizontal axis 127 and the swing axis 125. In another embodiment, the global origin point G is located at the point where the handle 135 is rotatably coupled to base 110. In other embodiments, the global origin, G, may be any predetermined point on the mining shovel 100. A first vector r is a vector from the bucket-actuator pin 215 to the local origin point O. A first global origin vector $r_1$ is a vector from the global origin point G to the bucket-actuator pin 215. A second global origin vector $r_2$ is a vector from the global origin point G to the local origin point O. An orthogonal vector r' is a vector orthogonal to the first vector r.

The payload data may be estimated by using the following equation:

$$\Sigma M_{hdl\ lug}=I\alpha \quad \text{[Equation 1]}$$

Where:
M=Moment about the pin 200
I=Inertia of the bucket 140
α=Angular acceleration of the bucket 140 about the pin 200

Equation 1 may be rewritten as Equation 2 below:

$$(F_{hst})d_1+(F_{cyl})d_2-(F_{bucket})d_3-(F_{material})d_4=(I_{bucket+material})\alpha_{bucket} \quad \text{[Equation 2]}$$

Where:
$F_{hst}$=Hoist force (e.g., mass sensed by pin sensor 395 or hoist torque sensor 390)
$F_{cyl}$=Actuator force sensed by actuator sensor 392
$F_{bucket}$=Bucket weight force of empty bucket
$F_{material}$=Material weight force
$I_{bucket+material}$=Material and Bucket Inertia about pin 200
$\alpha_{bucket}$=Angular acceleration of bucket about pin 200 sensed by pin sensor 395
$d_1$=Normal distance from pin 200 to the hoist rope
$d_2$=Normal distance from pin 200 to the tilt cylinder axis (e.g., actuator displacement sensed by actuator sensor 392)
$d_3$=Normal distance from pin 200 to bucket weight force
$d_4$=Normal distance from pin 200 to material weight force In some embodiments, the rotational angle of the bucket 140 is determined based on a sensed displacement of the actuator and a dimension of a component of the industrial machine. In such an embodiment, the dimension of the component of the industrial machine may be a distance between a first connection between the bucket and the pin (for example, at the bucket-handle pin 200) and a second connection between the actuator and the bucket (for example, at the bucket-cylinder pin 215). The rotational angle of the bucket 140, with respect to the horizontal axis 127, may be expressed as e, where e is equal to zero when the bucket-handle pin 200 axis and the bucket-cylinder pin 215 are on the same vertical line. Cos θ and sin θ may be determined by Equations 3-7 below.

$$r=a\hat{i}+b\hat{j} \quad \text{[Equation 3]}$$

$$r=r_2-r_1 \quad \text{[Equation 4]}$$

$$r'=b\hat{i}-a\hat{j} \quad \text{[Equation 5]}$$

$$\cos\theta=\frac{b}{|r|} \quad \text{[Equation 6]}$$

$$\sin\theta=\frac{-a}{|r|} \quad \text{[Equation 7]}$$

Equation 2 may further be rewritten into Equation 11, by using Equations 8-10 below:

$$F_{material}=c_1gx \quad \text{[Equation 8]}$$

$$d_4=d_5\cos\theta-d_6\sin\theta \quad \text{[Equation 9]}$$

$$I_{material}=c_6x+c_7 \quad \text{[Equation 10]}$$

$$(F_{hst})d_1+(F_{cyl})d_2-(F_{bucket})d_3-c_1gx(d_5\cos\theta-d_6\sin\theta)=(I_{bucket}+c_6x+c_7)\alpha_{bucket} \quad \text{[Equation 11]}$$

Where:
$d_5$=material center of gravity x-distance from the handle & bucket joint (e.g., pin 200) without the bucket rotated
$d_6$=material center of gravity y-distance from the handle & bucket joint (e.g., pin 200) without the bucket rotated In Equations 5-8, x is the fill factor. As discussed above, the fill factor x relates to the percentage of the bucket 140 filled with material (e.g., 0 is equivalent to 0% full, while 1 is equivalent to 100% full). Additionally, in Equations 5-8, $c_1$ is the bucket capacity (e.g., if the bucket capacity is 100 T, the $c_1$ is equal to 100 T), while $c_2$ to $c_7$ are constant coefficients related to the percentage of the bucket 140 filled with material. In some embodiments, constant coefficients $c_2$ to $c_7$ are predetermined. In such an embodiment, constant coefficients $c_2$ to $c_7$ may be predetermined through empirical testing. Additionally, distances $d_5$ and $d_6$ may be predetermined through empirical testing.

As illustrated in Equation 12, Equation 11 may be rewritten to solve for x.

$$x=\frac{-B+\sqrt{B^2-4AC}}{2A} \quad \text{[Equation 12]}$$

Where:
$A=c_1g[c_4\sin\theta-c_2\cos\theta]$
$B=c_1g(c_5\sin\theta-c_2\cos\theta)-c_6\alpha_{bucket}$
$C=(F_{hst})d_1+(F_{cyl})d_2-(F_{bucket})d_3-(I_{bucket}+c_7)\alpha_{bucket}$
When:
$(B^2-4AC)>0$ Thus, payload data (e.g., a fill factor of the bucket 140) may be determined by the above Equation 12.

Thus, the application provides, among other things, a system and method for accurately determining payload data for a mining machine, such as but not limited to, a material fill factor of a bucket of a mining machine. The system and method accurately determines the payload data without the need to estimate a crowd torque of a crowd motor. Furthermore, by accurately determining the payload data of the mining machine, an efficiency of the mining machine and the operator of the mining machine may be determined. Various features and advantages of the application are set forth in the following claims.

What is claimed is:

1. A method of determining payload data of a mining machine having a bucket and a handle, the bucket and handle rotatably coupled via a pin and an actuator, the method comprising:

sensing, via a first sensor, a first force associated with the actuator;

sensing, via a second sensor, a second force associated with the bucket;

determining, via a controller, a rotational angle of the bucket; and determining, via the controller, payload data based on the first force, the second force, and the rotational angle.

2. The method of claim 1, wherein the payload data is a percentage of the bucket filled with a material.

3. The method of claim 1, wherein the first force is a hydraulic force of the actuator.

4. The method of claim 1, wherein the first force is a torque of the actuator.

5. The method of claim 1, wherein the second force is a hoist force.

6. The method of claim 1, wherein the rotational angle of the bucket is relative to the handle.

7. The method of claim 1, wherein the first force, the second force, and the angle are determined during a swing deceleration operation.

8. The method of claim 1, wherein the step of determining the rotational angle of the bucket is based on a sensed displacement of the actuator and a dimension of a component of the mining machine.

9. An industrial machine comprising:

a base;

a handle rotationally coupled to the base;

a bucket rotationally coupled to the handle via a pin and an actuator;

a first sensor configured to sense an actuator force;

a second sensor configured to sense a hoist force;

a controller configured to receive the actuator force and the hoist force, determine a rotational angle of the bucket, and determine a payload data using the actuator force, the hoist force, and the rotational angle.

10. The industrial machine of claim 9, wherein the payload data is a percentage of the bucket filled with a material.

11. The industrial machine of claim 9, wherein the actuator force is a hydraulic force of the actuator.

12. The industrial machine of claim 9, wherein the actuator force is a torque of the actuator.

13. The industrial machine of claim 9, wherein the first sensor is further configured to determine a displacement of the actuator.

14. The industrial machine of claim 9, wherein the rotational angle of the bucket is relative to the handle.

15. The industrial machine of claim 9, wherein the actuator force, the hoist force, and the angle are determined during a swing deceleration operation of the mining machine.

16. The industrial machine of claim 9, wherein the rotational angle of the bucket is determined based on a sensed displacement of the actuator and a dimension of a component of the industrial machine.

17. The industrial machine of claim 16, wherein the dimension of the component is the distance between a first connection between the bucket and the pin and a second connection between the actuator and the bucket.

* * * * *